United States Patent [19]

Giorgio

[11] 4,358,986

[45] Nov. 16, 1982

[54] RIFLE BOLT ASSEMBLIES

[76] Inventor: Charles Giorgio, 48 Justin St., Smithfield, N.S.W, Australia

[21] Appl. No.: 183,163

[22] Filed: Sep. 2, 1980

[30] Foreign Application Priority Data

Sep. 11, 1979 [AU] Australia ..... PE0444

[51] Int. Cl.[3] ..... F41D 5/04

[52] U.S. Cl. ..... 89/142; 89/1 K; 89/185; 89/199; 89/128

[58] Field of Search ..... 89/1 K, 185, 199

[56] References Cited

U.S. PATENT DOCUMENTS

| | | | |
|---|---|---|---|
| 2,403,306 | 7/1946 | Sampson et al. | 89/199 |
| 3,318,192 | 5/1967 | Miller et al. | 89/199 |
| 3,386,336 | 6/1968 | Roy | 89/199 |

*Primary Examiner*—Stephen C. Bentley

*Attorney, Agent, or Firm*—Emory L. Groff, Jr.

[57] ABSTRACT

A rifle having a body comprised of hingedly interconnected lower and upper receivers, a trigger and hammer assembly mounted in the lower receiver, a barrel extending from one end of the upper receiver, an integrated bolt assembly removably mounted in the upper receiver, the bolt assembly comprising a bolt carrier slidably mounted on two action rods joined at corresponding first ends by an action plate, the action rods being releasably supported at corresponding ends in the rifle body, a bolt slidably mounted in the bolt carrier, a firing pin slidably mounted in the bolt, compression springs between the action plate and the bolt carrier and retaining means on the action rods to retain the bolt carrier on the action rods and retain the members of the bolt assembly integrated so the bolt assembly can be removed from the upper receiver as a complete unit.

7 Claims, 5 Drawing Figures

RIFLE BOLT ASSEMBLIES

This specification describes improvements in firearms. Specifically the improvements are directed to providing a firearm which is versatile and easy to maintain and operate.

The versatility will be apparent when it is understood that the weapon can be used as a pistol or a rifle type weapon and can be used as a single shot or an automatic firing weapon. The versatility is further enhanced by the use of a control element which when fitted to the weapon allows an automatic or semi-automatic fire pattern and when removed limits the weapon to single shot. This is a major advantage as in many situations, such as police actions and certain warfare situations, a commanding officer can determine the mode of weapon use and issue or withhold the control element depending upon whether the men under his control should be in a position to use automatic fire patterns. In known weapons the control over single shot (semi-automatic) or automatic fire patterns rests solely with the user.

A major structural advantage of the present weapon over known weapons is that the bolt assembly is removable as a complete unit, this allows for replacement (if damaged) and cleaning (if dirty) in a simple and convenient manner. Known weapons provide a bolt assembly which is comprised of many parts arranged in such a way when the bolt assembly is removed the user has a collection of non interconnected components or component groups which have to be re-assembled in the weapon after individual cleaning. The present invention has an advantage over such weapons particularly in a night combat situation where there is no light to assist in the stripping and re-assembling of the weapon.

The weapon of this invention has a firing rate, in automatic mode, slower than that of current automatic weapons and provides less recoil and "kick" than known comparable weapons. This is achieved by design features which will be described. The weapon also provides a new form of rear sight which is simple and effective.

The operational reliability of the weapon, as measured by the frequency with which components have to be cleaned, is high in the present weapon due to the type of construction used for the gas cocking mechanism and the bolt locking mechanism.

In order that all of the foregoing developments may be understood a presently preferred embodiment of the invention will now be described with reference to the accompanying drawings in which.

Figure 1:
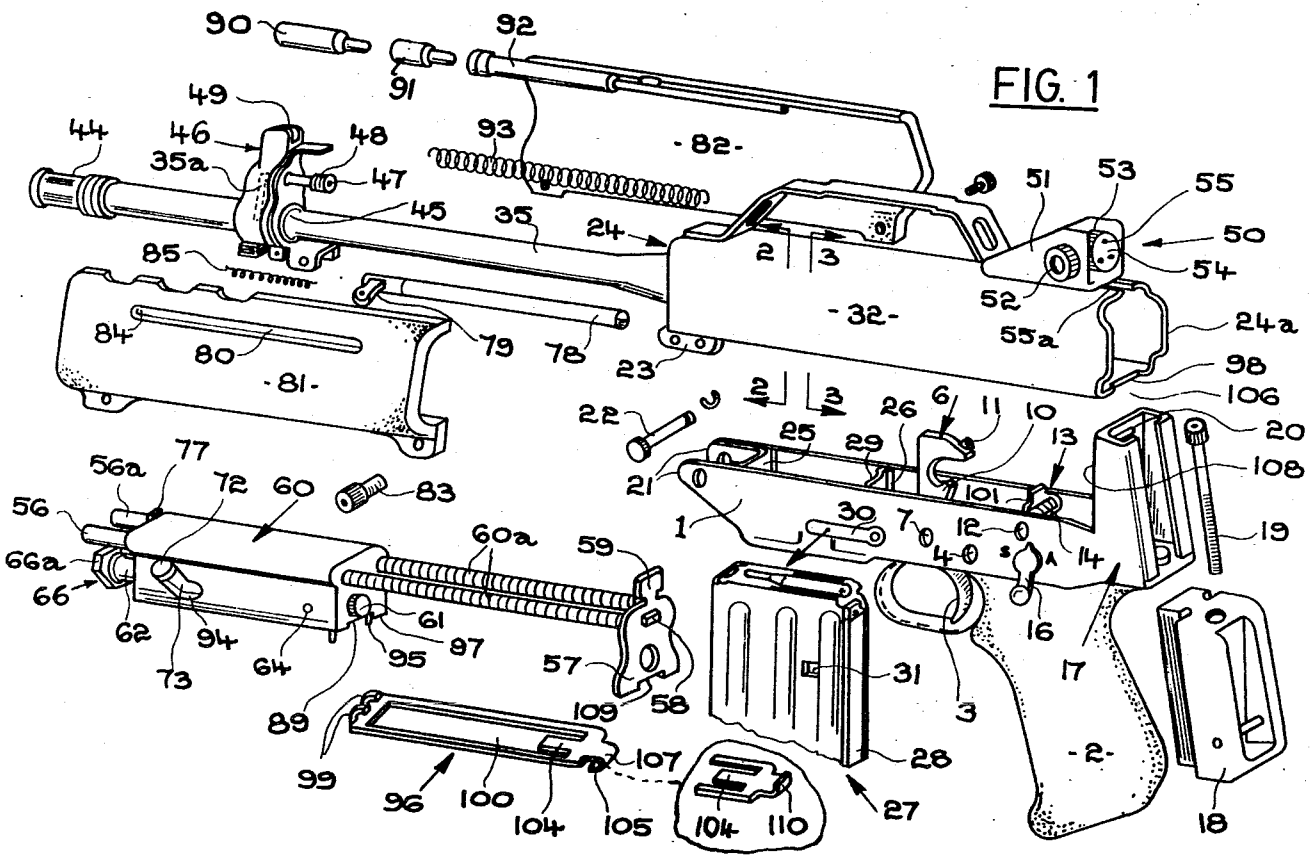
FIG. 1 is an exploded perspective view of the major parts of a weapon according to the invention.
Figure 4:
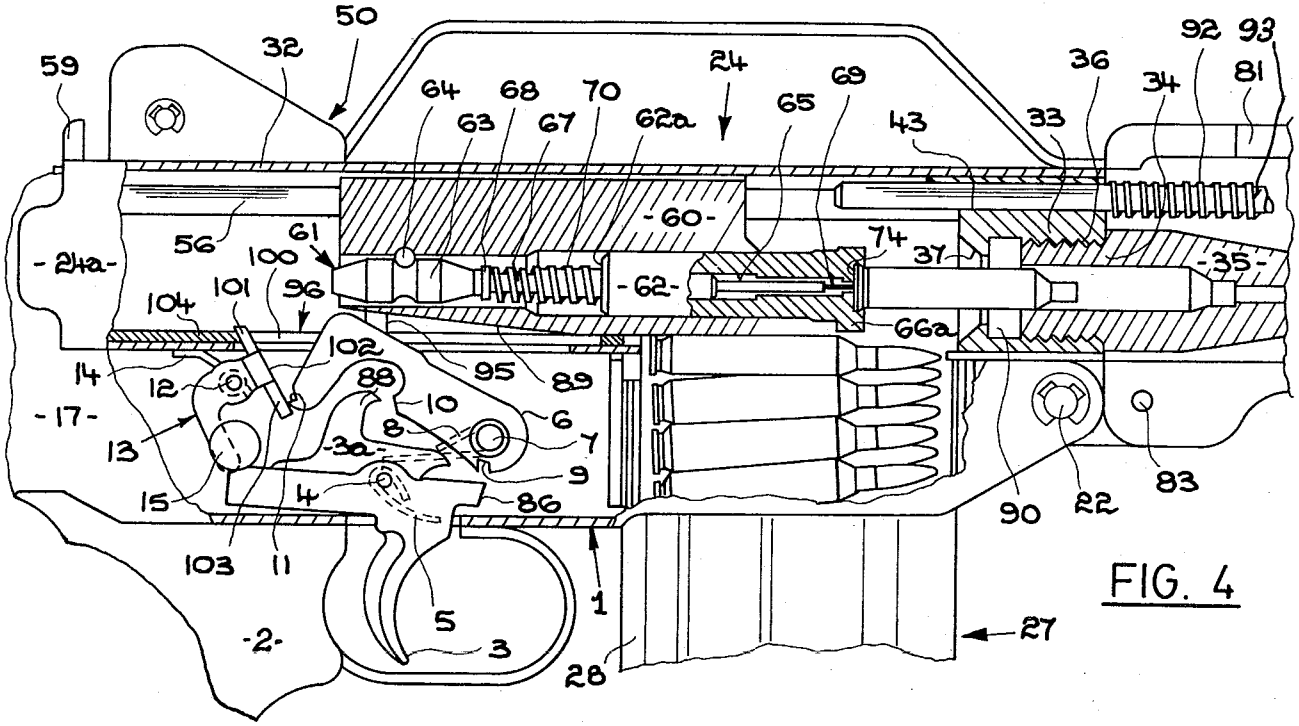
FIG. 4 is a side view partly in section of portion of the weapon of FIG. 1 at a cocking stage and FIG. 5 is a view similar to FIG. 4 of the weapon at a bullet loading stage.
Figure 5:
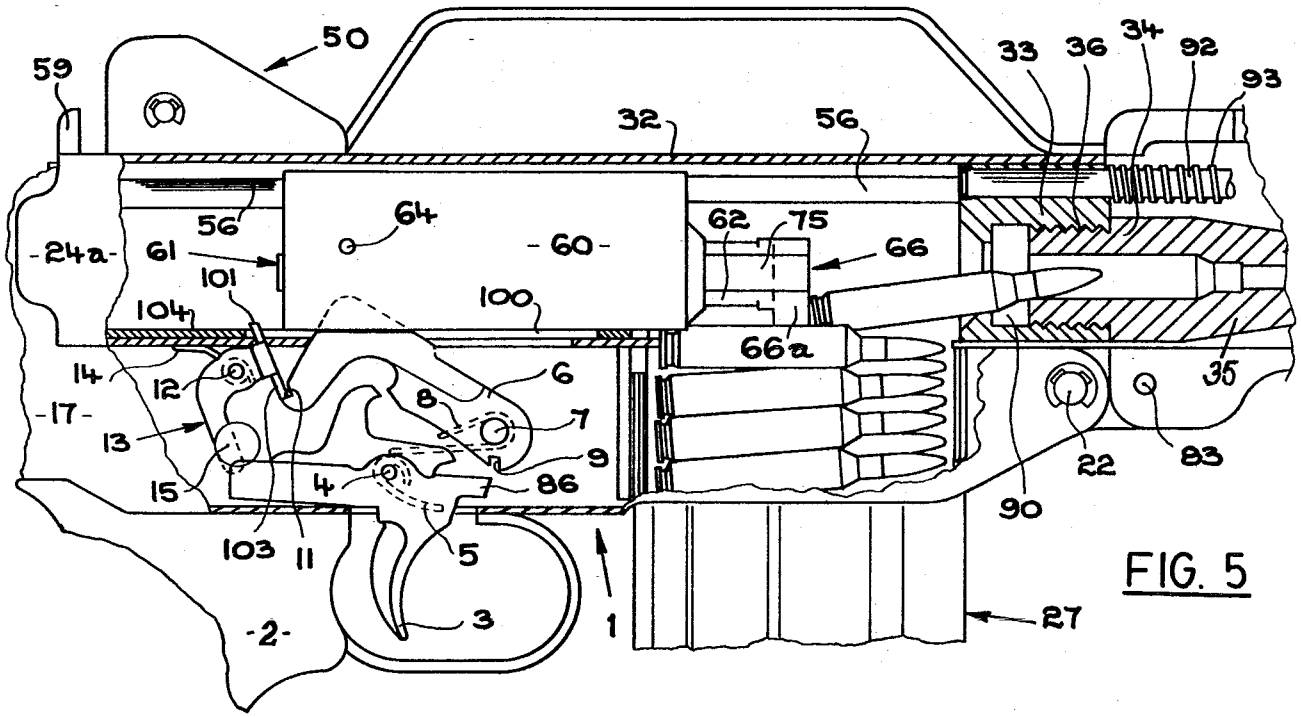

The weapon has a basic form comprising a lower receiver 1 with an attached hand grip 2. In the lower receiver 1 there is a trigger assembly which can be best seen in FIGS. 4 and 5 and comprises a trigger 3 pivoted on a pin 4 and is biased in an anti-clockwise direction by a torsion spring indicated 5 around the pin 4. A latch member 3*a* is pivotally mounted on pin 4, it moves with the trigger 3 about pin 4 and has a limited arc of movement relative to the trigger 3 and is biased in a clockwise direction about pin 4 by a hidden spring. There is a hammer 6 pivoted to the lower receiver about pin 7 and a torsion spring indicated 8 biases the hammer in a clockwise direction. The hammer 6 has a first lug 9 at its lower end, an intermediate lug 10 and an upper lug 11. Pivotally mounted at 12 is a sear, or automatic trigger, 13 spring biased by torsion spring 14 against a multi-lobed cam 15 inside the lower receiver 1 and coupled to a selector 16 which is illustrated in FIG. 1 in the single shot position. The letter S indicates the safety non-fire position for the selector 16 and the letter A indicates the automatic fire position.

At the rear end of the lower receiver is a stock support 17 to house a short stock 18, which is used when the weapon is in the pistol form, or a full stock (not shown). The stock is held in place by the screw 19. There is a notch 20 in the support 17 for a purpose to be described.

At the other end of the lower receiver there are two arms 21 to receive a pivot pin 22 to pivotally secure a tongue 23 of the upper receiver 24 to the lower receiver 1. In the lower receiver there are two transverse plates 25 and 26 to locate the upper end of a magazine 27. The magazine 27 has a longitudinal rib 28 to engage a locating groove 29 to the plate 26. The magazine 27 is secured in the lower receiver by a spring loaded catch comprising a plate 30 with a catch lug (not shown) to project into the interior of the lower receiver 1 so as to be engageable in a hole 31 in the magazine 27. The catch lug is disengaged from the hole 31 by laterally moving the catch plate 30 in the direction of the arrow by pressing a button (not shown) on the obscured side of the lower receiver 1, FIG. 1.

The upper receiver 24 comprises a tubular body 32 at one end of which there is internally fixed a barrel extension 33 with a bore threaded at 36 to receive the threaded first end 34 of a barrel 35. There are three evenly spaced circular segments 37 projecting into the bore of the barrel extension 33, they are separated by three gaps 38. The rearward surfaces of the segments 37 are angled, see FIG. 4 and there are two adjacent bullet ramps 39–40 in the two lowermost segments 37. The barrel extension 33 has a pair of action rod locating holes, 41, 42 see FIG. 4, hole 42 is counterbored. There is also a bearing 43 for an operating rod.

The barrel 35 has a flash suppressor 44 at its other end. Intermediate its ends the barrel 35 has an enlarged portion 45 on which there is mounted a gas housing 46 positioned so as to place a port 35*a* in the barrel 35 (which communicates with the bore thereof) in connection with a passageway 47 in the gas housing 46 which exits axially through a piston 48. The gas housing 46 also provides a support for a front sight 49. The upper receiver body 24 has at its other end a rear sight assembly 50 comprising a U bracket 51 with a transverse adjusting screw 52 which engages with a sight block 53 on which there is rotatably mounted a sight member in the form of a disc 54. The block 53 is moved laterally of the weapon by means of the screw 52 for windage adjustment. The disc 54 is rotated to one of three positions so as to locate one of the three holes 55 in the disc 54 in line with the front sight 49. The holes 55 in the disc 54 are at different spacings from the axis of rotation of the disc 54 to provide variations of rear sight height. Suitable detent means can be provided to releasably retain the disc 54 in a required location. Adjacent the U brackets 51 there is a slot 55*a* in the upper receiver in which catch means is engaged to hold the upper and lower receivers in operative relationship. The upper receiver 24 is laterally stabilised by lugs 24*a* on the upper receiver 24 which locate one to either side of the stock support 17.

Another component of the weapon is the bolt assembly, which is an integrated assembly of components able to be removed as an assembly. It comprises a pair of action rods 56–56*a* held at one end in spaced relationship by an action plate 57 having a closure rib 58 and a headed catch means 59 to engage in the slot 55*a* so as to hold the upper and lower receivers in their operative relationship.

Slidably mounted on the rods 56–56*a* is a bolt carrier 60 in which there is slidably mounted a firing pin striker 61 the sliding movement of which is limited by shoulders 63 and a pin 64 passing through the bolt carrier 60. A cylindrical bolt 62 is slidably mounted in the bolt carrier 60. The bolt 62 has an axial bore 65 and at one end a head 66 with three lobes 66*a*. Slidably mounted in the bore 62 there is a rod 67 with a head 68 at one end which lies adjacent striker 61. The bore 65 is of reduced diameter as it passes through the head 66 and a firing pin 69 in the other end of rod 67 is slidably supported in the reduced diameter portion of bore 65. A compression spring 70 encircling pin 67 between head 68 and shoulder 62*a* on bolt 62 and urges the head 68 into contact with striker 61 and retains the firing pin 69 clear of the floor of a recess 74 in the bolt head 66.

There is a cam pin 72 projecting radially from the bolt 62 and it engages in a cam track 73 in the bolt carrier. The recess 74 in the end of the bolt head 66 is central and has an associated spring loaded finger 75 of known type to grip the rim of a cartridge case and in the case of a spent cartridge to withdraw it from the barrel bore. There is also an ejector pin 75*a* of known type in the recess 74 which ejects a spent cartridge case through an elongated aperture 76 in the upper receiver 24 as the bolt carrier 60 retracts to a position where the cartridge case is free from lateral restraint. The bolt carrier 60 is retained on the action rods 56–56*a* by a circlip 77 on action rod 56*a* against which it is thrust by springs 60*a* on rods 56–56*a*.

The bolt assembly is mounted in the upper receiver by sliding it into the upper receiver body 32 so that the rods 56–56*a* engage respectively in a tubular member 78 in hole 41 in the barrel extension 33 and in hole 42 in the barrel extension 33 with the circlip 77 in the counterbore of hole 42. The headed catch 59 engages in the slot 55*a* and serves to guide the closing rib 58 as it is urged by springs 60*a* into the notch 20.

Prior to detailing the operation of the bolt assembly the trigger mechanism will be described. The following description will be followed with reference to FIGS. 4 and 5. With the selector 16 set for single shot, the trigger nose 86 is engaged with the hammer first lug 9 when the hammer is cocked, against the action of its biasing spring 8, by the rearward movement of the bolt carrier 60. Because of the speed with which the hammer is cocked the user is unable to release the trigger 3 quickly enough after a shot is fired to enable the trigger nose 86 to re-engage the hammer first lug 9 on the next cocking cycle. For this reason a latch means is provided to prevent hammer forward movement a second time. It comprises a latch member 3*a* pivoted on pin 4 and which, when the trigger is held depressed, is in a position to allow a lip 88 to engage the second hammer lug 10 on a cocking movement of hammer 6. When the trigger 3 is released by the operator the catch lug 10 is released by the lip 88 and clockwise movement of the hammer causes the trigger nose 86 to then engage the first hammer lug 9, ready for the next bullet to be fired. This single shot trigger-catch arrangement is well known and is to be found on several weapons presently in use. The automatic fire mode will be described later.

The operation of the bolt assembly depends on cocking the weapon. Means for manual cocking is provided and this comprises the tubular support 78 with a cocking handle 79 housed and guided by slot 80 in one half 81 of a two piece hand grip 81–82 which is unified by screws 83. The parts 81–82 clamp around the front end of the upper receiver and about the gas housing 46. The cocking handle is urged into contact with the end 84 of slot 80 by tension spring 85, connecting the cocking handle 79 to the handle part 81, housed within the hand grip assembly.

Operation of the bolt assembly as is follows. By pulling the cocking handle 79 towards the stock support 17 the bolt carrier 60 is pushed back by tube 78 to compress the springs 60*a*. As this occurs a cam face 89 on the underface of the bolt carrier 60 engages the top of the hammer and pivots the hammer against the resistance of spring 8 to engage the nose 86 of the trigger 3 with the first lug 9 to retain the hammer cocked. This enables a bullet to be urged, by spring means of known type in the magazine 22, into a position where it can be removed by the advancing bolt in the next firing operation and urged up ramp 39 or 40 of the barrel extension and into the barrel bore. At this time the recess 74 and the cartridge case rim grip 75 at the front of the bolt head 66 will have engaged the rear end of the cartridge case. As the bolt assembly continues to move forward the three lobes 66*a* of the bolt head 66 pass through the gaps 38 between the segments 37 of the barrel extension 33 and enter an unthreaded portion 90 of the bore of the barrel extension 33, to drive the bullet hard home in the barrel 35 and the pin and cam 72–73 are in the relationship illustrated in FIG. 1. The bolt carrier 60 can still continue to move longitudinally relative to the bolt 62 under the influence of the springs 60*a* until the front end of the carrier 60 rests against the barrel extension 33.

The relative longitudinal movement between the bolt carrier 60 and the bolt 62 causes the pin 72 to run along cam 73 and the bolt 62 to turn so that the lobes 66*a* lying in a plane behind the segments 37 move to a position behind the segments 37 thereby locking the bolt 62 against axial movement. About 30° of rotation is required for locking.

The bullet is now hard home in the barrel 35 with the bolt head 66 locked behind it. By squeezing the trigger 3 the nose 86 disengages the lug 9 and the hammer 6 hits the striker 61 which drives the firing pin 69 into the recess 74 of the bolt head 66 and into the end of the cartridge to detonate the charge therein. Gas is generated and the projectile portion of the bullet is discharged along the barrel bore by the gas. Automatic recocking of the trigger with associated ejection of the spent cartridge and reloading with a new bullet now takes place. Recocking can be achieved automatically by using some of the gas generated in the barrel when the bullet is fired. The gas is channelled through port 35*a* and passageway 47 to the piston 48 which is housed in one end of a movable three piece cylinder-plunger assembly. There is a cylinder part 90 which is a sliding fit, with ample clearance for reasons to be described, on the piston 48. There is a link member 91 and an operating rod 92 around which there is a spring 93. The rod 92 is slidably housed in hole 43 in the barrel extension 33 and end engages the bolt carrier 60. A portion of the gas generated in the barrel at firing is bled through piston 48 into cylinder 90 to move it and components 91 and 92, and as rod 92 rests on the bolt carrier 60 the bolt carrier 60 is pushed back against its springs 60*a*. It will be seen that the cam track 73 has a straight section 94 thus the first part of the backward movement of the bolt carrier 60 does not rotate the bolt 62. This is purposely done to allow the pressure of the gas in the barrel bore resulting from the firing of the bullet to drop to at least the level where the gas pressure is below that sufficient to expand the case into binding contact with the barrel bore. If cartridge case removal is attempted whilst it is expanded by excess pressure the rim could be ripped off leaving a spent case in the path of the next bullet. The gas pressure is also designed to co-act with designed masses of the moving parts and the strength of the springs 60*a* to obtain a return (cocking action) speed slower than would otherwise be the case. The interrelated effects of gas pressure, spring strength and moving masses builds into the weapon a predetermined firing rate, lessens wear and allows greater control of the weapon because the reaction forces to firing forces is small. The fit between the cylinder 90 and piston 48 is intentionally slack to allow blow-by of gas, this blows away burnt powder to atmosphere which powder might otherwise accumulate in the piston and cylinder. Such accumulation would necessitate, and does necessitate in some known weapons, frequent cleaning of these components.

The pin cam arrangement 72–73 rotates the bolt 62 as the bolt carrier continues to move and this release the interengaging lobes 66*a* and segments 37. The large arc of rotation of about 30° to disengage the lobes and segments is also a factor in slowing down the firing rate of the weapon. The gas energy exerted on the rod 92 hurls the bolt carrier 60 and its associated bolt 62 after unlocking rotation, rearwardly. The energy imparted by the gas is taken up in overcoming the inertia of the mass of the bolt carrier assembly and by the work done in compressing its springs 60*a*. During the return movement of the bolt carrier the used cartridge is withdrawn and ejected (as previously described) and the hammer is cocked. The energy stored in the springs 60*a* due to the rearward motion of the bolt carrier 60 is expended in the next firing operation by returning the bolt carrier 60 toward the barrel extension 33 and in removing a bullet from the magazine 27 along a ramp 39 or 40 into the barrel bore where it is retained by the relocked bolt head 66. The weapon is now ready for a further single shot to be fired.

Figure 3:
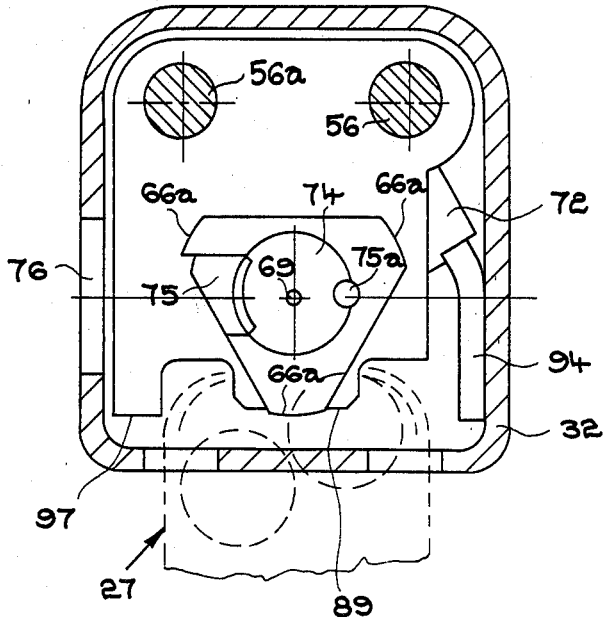
FIG. 3 is a cross-sectional view on the section line 3—3 of FIG. 1.

The manner of removing a round of ammunition from the magazine 27 is best seen in FIG. 3 which also shows a guide bar 94 fixed to the inside of the upper receiver 24. The purpose of the bar 94 is to prevent premature rotation of the bolt 62 in the bolt carrier 60 in a bullet loading operation. There is a tendency to premature rotation of the bolt 62 because of the eccentric engagement of an edge of a lobe of head 66 with a cartridge case as it is withdrawn from the magazine 27 by the advancing bolt assembly. The track 94 drops away adjacent the barrel extension 33 leaving the pin 72 free to be moved by the cam 73 and so permit the required cam action necessary to turn the bolt 62.

The remaining aspect of the gun is the conversion from a single shot (semi-automatic) weapon to a fully automatic weapon. This is achieved by inter-action between pegs 95 on the under face of the bolt carrier 60 and lugs 99 on a slide 96. The slide 96 is located between wall 98 of the upper receiver 24 with one long side below a runner bar 97 on the under face of the bolt carrier 60 and its other long side below bar 94. The slide includes a cutout 100 in which is located the end 101 of the sear blade 102. In operation the selector 16 is positioned for automatic (position A) this positions a selector cam to prevent latch member 3*a* engaging the hammer lug 10 and also positions the end 103 of the blade 102 of the sear 13 so it can engage the hammer lug 11 as the hammer is cocked by the returning bolt carrier 60. When the bolt carrier 60 moves in a cocking operation the pegs 95 retreat from engagement with the lugs 99 on the slide 96 and the sear spring causes the end 101 of the sear blade 102 to bear on the part 104 of slide 96 to move the slide toward the action plate 57. The sear 13 takes up a position (as determined by the selector cam) such that as the cocking of the hammer takes place the end 101 of the sear 13 engages the hammer lug 11. On the return of the bolt carrier 60 under the influence of its springs 60*a* the pegs 95 pass over the slide 96 until they engage the lugs 99. This occurs instantaneously after the bullet is hard home and the bolt has been rotated and locked. The slide 96 is then moved with the bolt carrier 60 for a very small distance and the slide part 104 catches the upper sear blade end 101 to disengage the sear blade end 103 from the hammer lug 11. At this stage if the trigger is not depressed the trigger nose 86 will engage the hammer lug 9 preventing further hammer advance. When the trigger 3 is depressed it removes the trigger nose 86 from the hammer lug 9 and the hammer hits the striker 61. The gas cocking action for each successive firing takes place as described above. With the trigger still depressed the only hammer lug operating is the lug 11 and with the lower end 103 of the sear blade. This engagement is automatically tripped by the plate 96 (as described above) as long as the trigger is held depressed and continuous firing will continue.

To limit the movement of the slide 96 in a forward direction there is a hook end 105 which engages in a notch 106 in the lower wall 98 of the upper receiver. To limit it in the opposite direction the outer end 107 of hook 105 abuts the inner face 108 of the stock support 17. It will be understood that the movement of slide 96 is quite small. A notch 109 in the bottom of the action plate is provided to accommodate the body of hook 105.

Figure 2:
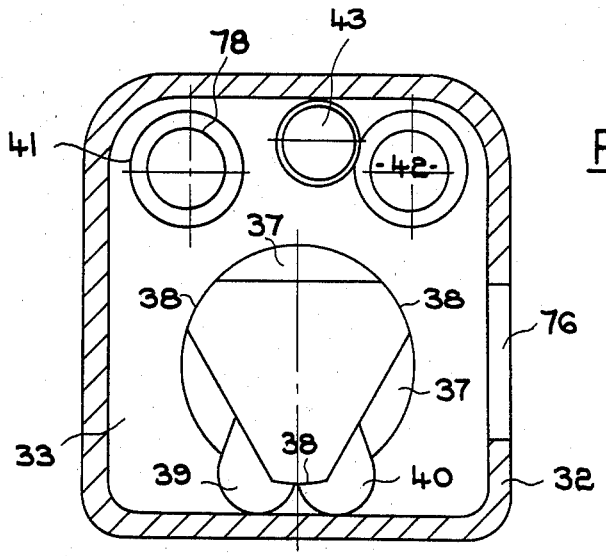
FIG. 2 is a cross-sectional view on the section line 2—2 of FIG. 1.

It will be noted from FIG. 2 that the cam 89 is in the form of a rib and that the slide lugs 99 and the pegs 95 are located to either side of the cam 89.

The weapon can be readily changed from automatic to single shot (semi-automatic) by positioning the selector 16 and removing the plate 96. The plate 96 may be left installed however and the selector merely moved to single shot.

The hook 105 may be replaced by an upturned lug 110 (see inset).

The foregoing description clearly illustrates the operation of the weapon, its several novel features and explains the advantages hereinbefore identified.

I claim:

1. A rifle comprising a lower receiver and an elongated tubular upper receiver in operative overlying relationship; a barrel assembly mounted in and projecting from a first end of the upper receiver; a trigger and hammer assembly mounted in the lower receiver; an opening in the upper receiver to allow a firing pin striking hammer of the hammer assembly to project into the upper receiver; a bolt assembly comprising a bolt carrier, two parallel action rods demountably supported longitudinally in the upper receiver in a plane parallel to the plane occupied by the axis of the bore of the barrel assembly, bearing means in the bolt carrier slidably engaging the action rods, a bolt slidably and part rotatably mounted in the bolt carrier and projecting from one end thereof with the axis of sliding movement aligned with the axis of the bore of the barrel assembly and with a head lockable in a recess in said barrel assembly, a firing pin assembly axially slidably mounted in the bolt and projecting from the other end of the bolt carrier, an action plate interconnecting the ends of the action rods adjacent said other end of the bolt carrier, compression springs on the action rods interposed between said other end of the bolt carrier and the action plate; characterised by retaining means on one action rod located between said one end of the bolt carrier and the other end of said one action rod to retain the bolt carrier on the action rods and thereby integrate the bolt carrier and the action rods enabling that integrated assembly to be removed as a complete unit from the rifle, releasable catch means to lock the upper and lower receivers in operative overlying relationship, said catch means including a lug on said action plate and a recess in the lower receiver urged into engagement by the compression springs on the action rods, said action rods being supported in the upper receiver by said catch means and by support means in the barrel assembly engaged by said other ends of said action rods, said support means including a manually operable cocking rod slidably housed in a bearing in the barrel assembly, an axial bearing in a first end of the cocking rod to slidably receive said other action rod, a cocking handle on the cocking rod and biasing means to bias the cocking rod in a direction away from the bolt carrier.

2. A rifle as claimed in claim 1 in which the trigger and hammer assembly includes a trigger pivotally mounted in the lower receiver and spring biassed in a first direction, the hammer being mounted in the lower receiver and spring biassed in a direction opposite to the first direction, an upper lug on the hammer; a hammer cocking cam face on the bolt carrier; a sear plate pivotally housed in the lower receiver and spring biased in said first direction and including an upper face and a lower face and an arm; variable cam means in the lower receiver engageable by the sear plate arm to position the sear plate in an operative or an inoperative position for automatic or single shot rifle operation respectively; a removable slide slidably located between the undersurface of the bolt carrier and an inner surface of the upper receiver, a first operating face on the slide engageable by striker means on the bolt carrier as the bolt carrier nears the ends of a movement towards the barrel assembly, a second operating face on the slide engaged by the upper face of the sear plate; the positioning of the components being such that on a rearward movement of the bolt carrier away from the barrel assembly in automatic operation of the rifle the striker means moves away from the slide first operating face thereby allowing the sear plate biasing spring to move the slide in the same direction through engagement of the sear plate upper face with the slide second operating face and allowing engagement of the hammer top lug with the sear lower face as the hammer cocking cam face of the bolt carrier rotates the hammer against its spring bias; movement of the bolt carrier in the opposite direction resulting in said striker means engaging the slide first operating face to move the slide towards the barrel assembly and rotate the sear plate against the bias of its spring to disengage the sear lower face from the hammer upper lug allowing the hammer to rotate and strike the firing pin in the bolt assembly.

3. A rifle as claimed in claim 2 wherein, the bolt carrier underface includes a cam track to cock the hammer.

4. A rifle as claimed in claim 2 wherein, the slide is a generally rectangular ring and said first operating face comprises spaced upstanding lug means at one narrow end of the slide and said second operating face is a tongue in the plane of the slide and projecting inwardly into the open central portion of the slide from the other narrow end of the slide, and wherein the striker means is two pegs one to either side of the cam track to engage the slide lugs.

5. A rifle as claimed in claim 4 including, a downturned travel limiting hooked lug at said other end of the slide to engage over the other end of the lowermost face of the upper receiver.

6. A rifle as claimed in claim 1 wherein the bolt head has three lobes, said recess in the barrel assembly includes three lugs separated by three gaps through which the bolt lobes can pass and the degree of rotation of the bolt is such as to lock said three lobes behind said three lugs.

7. A rifle as claimed in claim 1 wherein the bolt is rotated by interengaged cam and peg means on the bolt and the bolt carrier and said cam includes a ramped portion to rotate the bolt and a straight portion parallel to the axial movement of the bolt to provide axial movement of the bolt carrier relative to the bolt prior to the rotation of the bolt in an unlocking movement of the bolt head in the recess of the barrel assembly.

* * * * *